US005741076A

United States Patent [19]

Cammack

[11] Patent Number: 5,741,076

[45] Date of Patent: Apr. 21, 1998

[54] PRODUCE BAG

[76] Inventor: Farrell D. Cammack, 1435 Lemon St., Blackfoot, Id. 83221

[21] Appl. No.: 767,209

[22] Filed: Dec. 16, 1996

Related U.S. Application Data

[63] Continuation-in-part of Ser. No. 58,650, Aug. 9, 1996.

[51] Int. Cl.[6] ..... B65D 30/06

[52] U.S. Cl. ..... 383/9; 206/554; 383/117

[58] Field of Search ..... 383/9, 117; 206/554

[56] References Cited

U.S. PATENT DOCUMENTS

| | | | |
|---|---|---|---|
| 692,405 | 2/1902 | Wright | 383/117 |
| 692,406 | 2/1902 | Wright | 383/117 |
| 1,725,864 | 8/1929 | James | 383/117 |
| 2,544,223 | 3/1951 | Ellis | 383/117 |
| 2,550,464 | 4/1951 | Gleave et al. | 383/117 |
| 2,616,468 | 11/1952 | Brady | 383/117 |
| 2,712,843 | 7/1955 | Ottinger et al. | 383/117 |
| 4,207,983 | 6/1980 | Wolske | 206/554 |
| 4,403,637 | 9/1983 | Sabater et al. | 383/9 |
| 4,949,842 | 8/1990 | Mokiao, II | 383/117 |
| 5,092,682 | 3/1992 | Fenick | 383/117 |
| 5,401,101 | 3/1995 | Wang | 383/117 |

FOREIGN PATENT DOCUMENTS

| | | | |
|---|---|---|---|
| 1406639 | 6/1965 | France | 383/117 |
| 18818 | 8/1910 | United Kingdom | 383/117 |

*Primary Examiner*—Stephen P. Garbe

[57] ABSTRACT

A new Produce Bag for offering a more efficient and effective packaging method for fruits and vegetables. The inventive device includes a bottom portion, and a top portion joined to the bottom portion to form a tubular body defining a pair of superimposed panels in a flattened state, wherein the tubular body has an open top end and a closed bottom end. The bottom portion is made from a net material and the top portion is made from a sheet material, wherein the top portion is adapted for use with a standard automatic bag filling machine as well as a standard automatic bag closure machine. Whereas a bag made entirely from a net material cannot be used with a standard automatic bag filling machine nor a standard automatic bag closure machine. The top portion includes a front panel and a back panel wherein the back panel includes an extended portion extending beyond a top edge of the front panel. A pair of spaced holes and a pair of spaced slits are provided in the extended portion of the back panel to allow the produce bag to be used with a standard automatic bag filling machine. The pair of spaced holes allow the produce bag to be hung from a pair of protruding hanger rods provided on a standard automatic bag filling machine and the pair of spaced slits facilitate removal of the produce bag from the pair of protruding hanger rods after the produce bag has been filled.

10 Claims, 4 Drawing Sheets

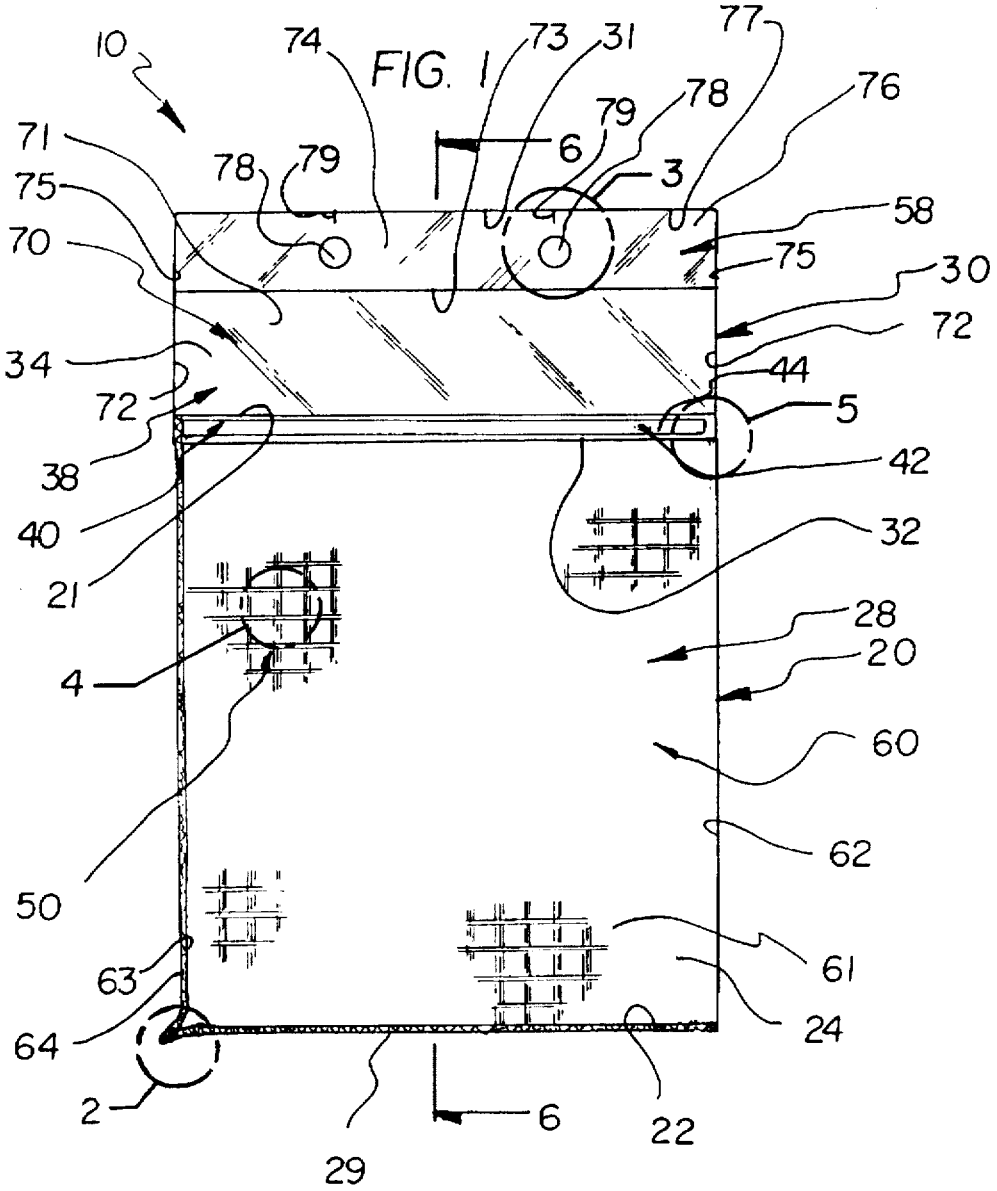
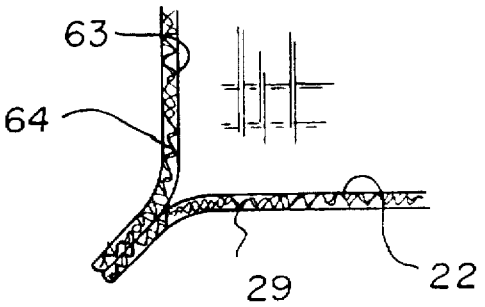
FIG. 2

PRODUCE BAG

CROSS REFERENCE TO RELATED APPLICATION

This application is a continuation-in-part of my prior design patent application Ser. No. 29/058,650, filed Aug. 9, 1996.

BACKGROUND OF THE INVENTION

1. Field of the Invention

The present invention relates to net bags and more particularly pertains to a new Produce Bag for offering a more efficient and effective packaging method for fruits and vegetables.

2. Description of the Prior Art

The use of net bags is known in the prior art. More specifically, net bags heretofore devised and utilized are known to consist basically of familiar, expected and obvious structural configurations, notwithstanding the myriad of designs encompassed by the crowded prior art which have been developed for the fulfillment of countless objectives and requirements.

Known prior art net bags include U.S. Pat. No. 5,050,999; U.S. Pat. No. 4,795,268; U.S. Pat. No. D330,852; U.S. Pat. No. 5,385,766; U.S. Pat. No. D360,797 and U.S. Pat. No. 5,211,191.

While these devices fulfill their respective, particular objectives and requirements, the aforementioned patents do not disclose a new Produce Bag. The inventive device includes a bottom portion, and a top portion joined to the bottom portion, wherein the bottom portion is made from a net material and wherein the top portion is made from a sheet material and is adapted for use with standard automatic bag filling machines as well as standard automatic bag closure machines. Whereas a bag made entirely from a net material cannot be used with standard automatic bag filling machines nor standard automatic bag closure machines.

In these respects, the Produce Bag according to the present invention substantially departs from the conventional concepts and designs of the prior art, and in so doing provides an apparatus primarily developed for the purpose of offering a more efficient and effective packaging method for fruits and vegetables.

SUMMARY OF THE INVENTION

In view of the foregoing disadvantages inherent in the known types of net bags now present in the prior art, the present invention provides a new Produce Bag construction wherein the same can be utilized for offering a more efficient and effective packaging method for fruits and vegetables.

The general purpose of the present invention, which will be described subsequently in greater detail, is to provide a new Produce Bag apparatus and method which has many of the advantages of the net bags mentioned heretofore and many novel features that result in a new Produce Bag which is not anticipated, rendered obvious, suggested, or even implied by any of the prior art net bags, either alone or in any combination thereof.

To attain this, the present invention generally comprises a bottom portion, and a top portion joined to the bottom portion, wherein the bottom portion is made from a net material and wherein the top portion is made from a sheet material and is adapted for use with standard automatic bag filling machines as well as standard automatic bag closure machines. Whereas a bag made entirely from a net material cannot be used with standard automatic bag filling machines nor standard automatic bag closure machines.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Produce Bag apparatus and method which has many of the advantages of the net bags mentioned heretofore and many novel features that result in a new Produce Bag which is not anticipated, rendered obvious, suggested, or even implied by any of the prior art net bags, either alone or in any combination thereof.

It is another object of the present invention to provide a new Produce Bag which may be easily and efficiently manufactured and marketed.

It is a further object of the present invention to provide a new Produce Bag which is of a durable and reliable construction.

An even further object of the present invention is to provide a new Produce Bag which is susceptible of a low cost of manufacture with regard to both materials and labor, and which accordingly is then susceptible of low prices of sale to the consuming public, thereby making such Produce Bag economically available to the buying public.

Still yet another object of the present invention is to provide a new Produce Bag which provides in the apparatuses and methods of the prior art some of the advantages thereof, while simultaneously overcoming some of the disadvantages normally associated therewith.

Still another object of the present invention is to provide a new Produce Bag for offering a more efficient and effective packaging method for fruits and vegetables.

Yet another object of the present invention is to provide a new Produce Bag which includes a bottom portion, and a top portion joined to the bottom portion, wherein the bottom portion is made from a net material and wherein the top portion is made from a sheet material and is adapted for use with standard automatic bag filling machines as well as standard automatic bag closure machines. Whereas a bag made entirely from a net material cannot be used with standard automatic bag filling machines nor standard automatic bag closure machines.

Still yet another object of the present invention is to provide a new Produce Bag that is adapted for use with standard automatic bag filling machines.

Even still another object of the present invention is to provide a new Produce Bag that is adapted for use with standard automatic bag closure machines.

Even still another object of the present invention is to provide a new Produce Bag that allows air to circulate among the contents thereof.

Even still another object of the present invention is to provide a new Produce Bag that would help keep fruits and vegetables fresh and appealing.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an illustration of a new Produce Bag according to the present invention.

FIG. 2 is a detailed illustration of area 2 of FIG. 1.

DESCRIPTION OF THE PREFERRED EMBODIMENT

Figure 3:
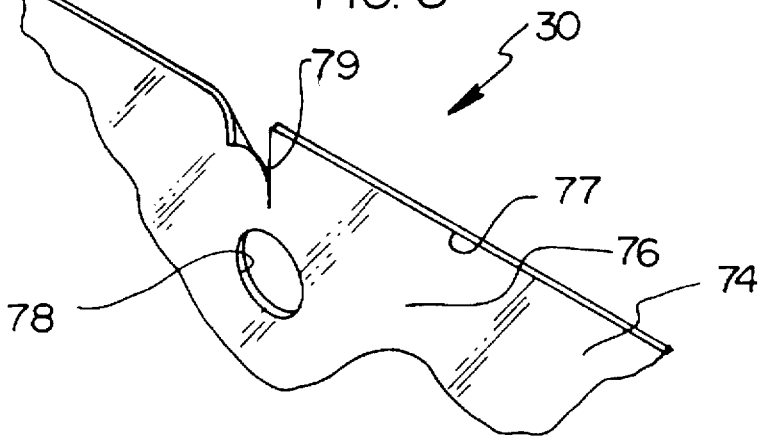
FIG. 3 is a detailed illustration of area 3 of FIG. 1.

With reference now to the drawings, and in particular to FIGS. 1 through 6 thereof, a new Produce Bag embodying the principles and concepts of the present invention and generally designated by the reference numeral 10 will be described.

More specifically, it will be noted that the Produce Bag 10 comprises a bottom portion 20, and a top portion 30 joined to the bottom portion 20, wherein the bottom portion 20 is made from a net material 50 and wherein the top portion 30 is made from a sheet material 58 and is adapted for use with a standard automatic bag filling machine as well as a standard automatic bag closure machine. Whereas a bag made entirely from a net material 50 cannot be used with a standard automatic bag filling machine nor a standard automatic bag closure machine. The net material 50 and the sheet material 58 are a plastic material such as polyethylene.

Figure 6:
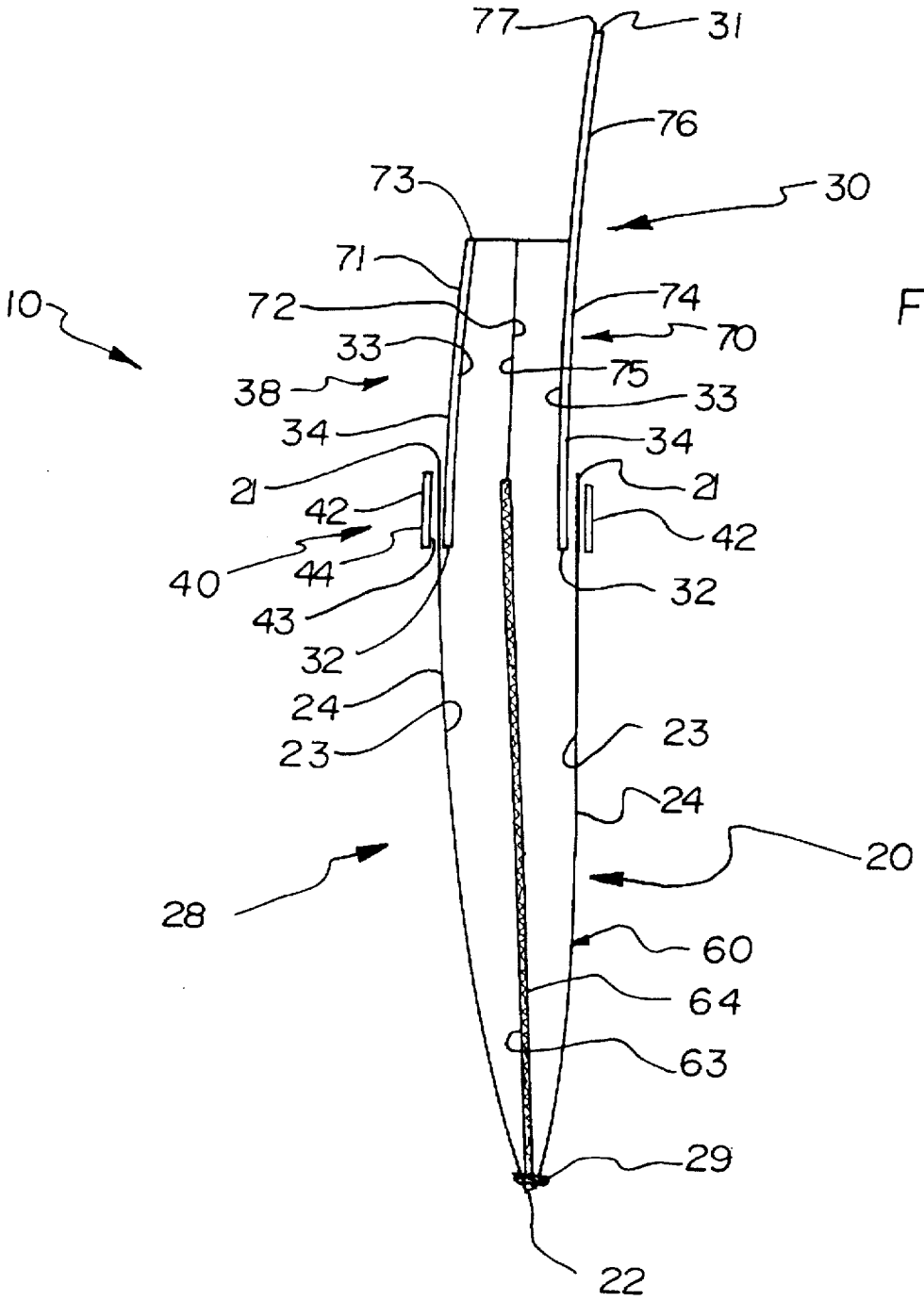
FIG. 6 is a cross sectional view taken along line 6—6 of FIG. 1.

As best illustrated in FIGS. 1 and 6, it can be shown that the bottom portion 20 comprises a bottom tubular body 60 defining a pair of superimposed bottom panels 28 when in a flattened state. The bottom portion 20 has a top end 21 and a bottom end 22, wherein the top end 21 is open and the bottom end 22 is closed. The bottom end 22 of the bottom portion 20 is defined by a bottom seam 29 joining the pair of superimposed bottom panels 28 together. The bottom portion 20 also has an interior surface 23 and an exterior surface 24.

As best illustrated in FIG. 1, it can be shown that the bottom tubular body 60 comprises a single panel 61, wherein the single panel 61 is folded to form the pair of superimposed bottom panels 28. The pair of superimposed bottom panels 28 has a folded edge 62 and a closed edge 63. The closed edge 63 is defined by a side seam 64 joining the pair of superimposed bottom panels 28 together.

Figure 4:
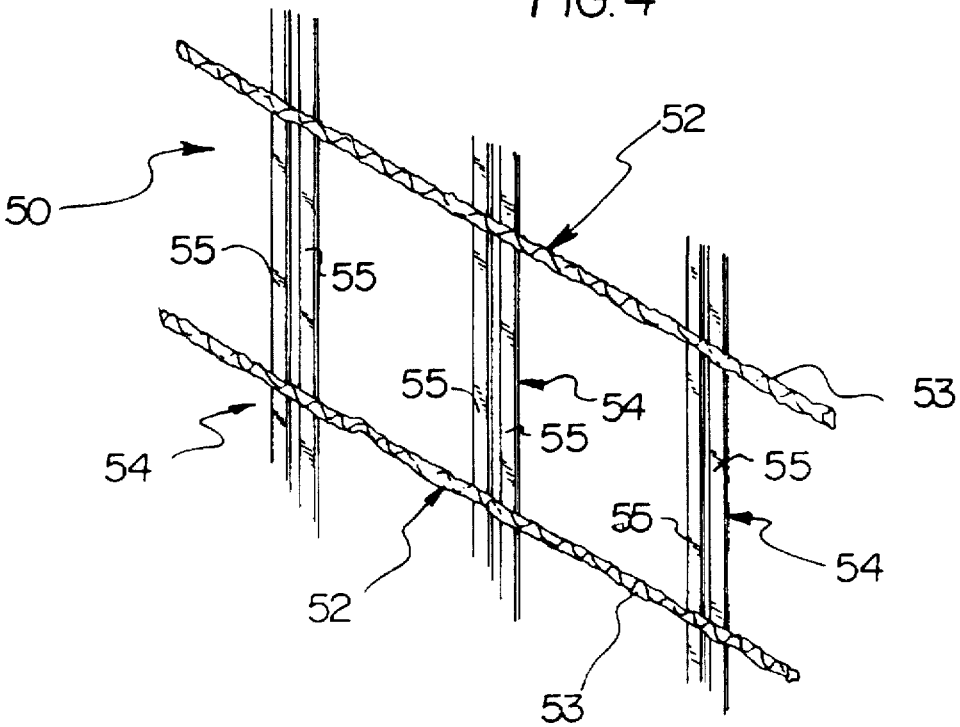
FIG. 4 is a detailed illustration of area 4 of FIG. 1.

As best illustrated in FIG. 4, it can be shown that the bottom portion 20 is made from a net material 50 comprising a plurality of parallel horizontal strands 52 and a plurality of parallel vertical strands 54 interwoven within the plurality of parallel horizontal strands 52. Each of the plurality of parallel horizontal strands 52 comprises a plurality of single strands 53 woven together. Each of the plurality of parallel vertical strands 54 comprises a pair of parallel strands 55.

As best illustrated in FIGS. 1 and 6, it can be shown that the top portion 30 comprises a top tubular body 70 defining a pair of superimposed top panels 38 when in a flattened state. The top portion 30 has a top end 31 and a bottom end 32, wherein the top end 31 and the bottom end 32 are open. The top portion 30 also has an interior surface 33 and an exterior surface 34.

As best illustrated in FIG. 1, it can be shown that the top tubular body 70 comprises a front panel 71 having parallel side edges 72 and a top edge 73, and a back panel 74 having parallel side edges 75. One of the parallel side edges 72 of the front panel 71 and one of the parallel side edges 75 of the back panel 74 are joined and another of the parallel side edges 72 of the front panel 71 and another of the parallel side edges 75 of the back panel 74 are joined to form the pair of superimposed top panels 38.

As best illustrated in FIGS. 1 and 2, it can be shown that the back panel 74 includes an extended portion 76 extending beyond the top edge 73 of the front panel 71, wherein the extended portion 76 has a top edge 77. A pair of spaced holes 78 and a pair of spaced slits 79 are provided in the extended portion 76 of the back panel 74. The pair of spaced slits 79 are provided between the pair of spaced holes 78 and the top edge 77 of the extended portion 76 and are positioned along a vertical axis of the pair of spaced holes 78. The pair of spaced slits 79 extend to and are open at one end to the top edge 77 of the extended portion 76 of the back panel 74.

The pair of spaced holes 78 and the pair of spaced slits 79 provided in the extended portion 76 of the back panel 74 allow the Produce Bag 10 to be used with a standard automatic bag filling machine. The pair of spaced holes 78 allow the Produce Bag 10 to be hung from a pair of protruding hanger rods provided on a standard automatic bag filling machine and the pair of spaced slits 79 facilitate removal of the Produce Bag 10 from the pair of protruding hanger rods after the Produce Bag 10 has been filled. Applying a generally downward force to the Produce Bag 10 causes the extended portion 76 of the back panel 74 to tear between the pair of spaced holes 78 and the pair of spaced slits 79 thereby freeing the Produce Bag 10 from the pair of protruding hanger rods of the standard automatic bag filling machine.

Figure 5:
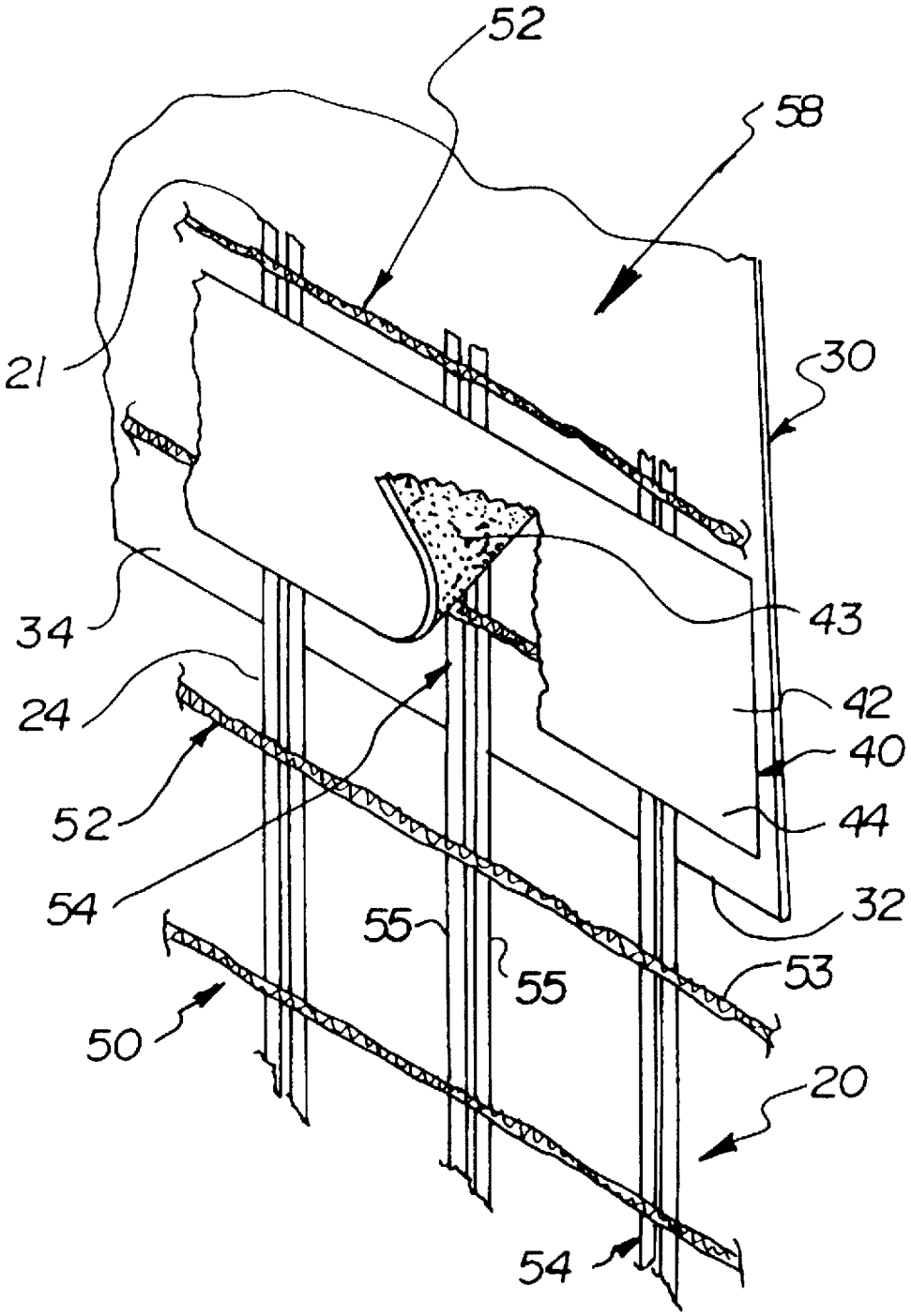
FIG. 5 is a detailed illustration of area 5 of FIG. 1.

As best illustrated in FIG. 5, it can be shown that a means for joining the top portion to the bottom portion 40 is provided. The means for joining the top portion to the bottom portion 40 comprises an adhesive strip 42 having an adhesive side 43 and a non-adhesive side 44. The bottom end 32 of the top portion 30 is positioned within the top end 21 of the bottom portion 20 whereby the top end 21 of the bottom portion 20 and the bottom end 32 of the top portion 30 overlap such that the exterior surface 34 of the top portion 30 is adjacent the interior surface 23 of the bottom portion 20. The adhesive side 43 of the adhesive strip 42 is placed adjacent the exterior surface 24 of the bottom portion 20 such that the adhesive side 43 contacts and adheres to the exterior surface 24 of the bottom portion 20 and contacts and adheres to the exterior surface 34 of the top portion 30 thereby joining the bottom end 32 of the top portion 30 to the top end 21 of the bottom portion 20.

In use, the Produce Bag 10 is hung from a pair of protruding hanger rods provided on a standard automatic bag filling machine whereby the pair of protruding hanger rods are inserted into the pair of spaced holes 78 provided in the extended portion 76 of the back panel 74 of the top portion 30. The front panel 71 of the top portion 30 is pulled outward so as to open the top end 31 of the top portion 30 of the Produce Bag 10. After the Produce Bag 10 has been filled, a generally downward force is applied to the Produce Bag 10 causing the extended portion 76 of the back panel 74 to tear between the pair of spaced holes 78 and the pair of spaced slits 79 thereby freeing the Produce Bag 10 from the pair of protruding hanger rods of the standard automatic bag filling machine. The filled Produce Bag 10 is then closed by a standard automatic bag closure machine whereby the top portion 30 of the Produce Bag 10 is gathered and closed with a fastening device such as a wire tie or a quick lock.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A Produce Bag, comprising:

a bottom portion, said bottom portion comprising a bottom tubular body defining a pair of superimposed bottom panels in a flattened state, said bottom portion having a top end and a bottom end, and having an interior surface and an exterior surface, said top end being open and said bottom end being closed, said bottom end defined by a bottom seam joining said pair of superimposed bottom panels together, said bottom portion formed of a net material;

a top portion, said top portion comprising a top tubular body defining a pair of superimposed top panels in a flattened state, said top portion having a top end and a bottom end, and having an interior surface and an exterior surface, said top end and said bottom end being open, said top portion formed of a sheet material, said top portion including a front panel having a top edge and a back panel, said back panel including an extended portion extending beyond said top edge of said front panel, said extended portion having a top edge, said extended portion of said back panel having a pair of spaced holes and a pair of spaced slits provided therein, said pair of spaced slits provided between said pair of spaced holes and said top edge of said extended portion and positioned along a vertical axis of said pair of spaced holes, said pair of spaced slits contiguous with said top edge of said extended portion, said bottom end of said top portion fitted within said top end of said bottom portion, whereby said top end of said bottom portion and said bottom end of said top portion overlap; and an adhesive strip joining said top portion to said bottom portion, said adhesive strip having an adhesive side and a non-adhesive side, said adhesive side of said adhesive strip positioned adjacent said exterior surface of said bottom portion along said top end of said bottom portion, said adhesive side contacting and adhering to said exterior surface of said bottom portion and contacting and adhering to said exterior surface of said top portion through said bottom portion, whereby said top end of said bottom portion is interposed between said adhesive strip and said bottom end of said top portion, wherein said top edge of said front panel of said top portion extends substantially beyond said top end of said bottom portion, whereby said top portion is adapted for use with a standard automatic bag filling machine and a standard automatic bag closure machine.

2. The Produce Bag of claim 1, wherein said bottom tubular body comprises a single panel, said single panel being folded to form said pair of superimposed bottom panels, said pair of superimposed bottom panels having a folded edge and a closed edge, said closed edge defined by a side seam joining said pair of superimposed bottom panels together.

3. The Produce Bag of claim 1, wherein said net material and said sheet material are a plastic material.

4. The Produce Bag of claim 3, wherein said plastic material is polyethylene.

5. The Produce Bag of claim 1, wherein said net material comprises:

a plurality of parallel horizontal strands, and a plurality of parallel vertical strands interwoven within said plurality of parallel horizontal strands.

6. The Produce Bag of claim 5, wherein each of said plurality of parallel horizontal strands comprises a plurality of single strands woven together.

7. A Produce Bag, comprising:

a tubular body defining a pair of superimposed panels in a flattened state, said tubular body having a top end and a bottom end, said top end being open and said bottom end being closed, said tubular body comprising a top portion, said top portion formed of a sheet material and having a bottom end, said top portion including a front panel and a back panel, said front panel having a top edge, said back panel including an extended portion extending beyond said top edge of said front panel, said extended portion having a top edge, said extended portion of said back panel having a pair of spaced holes and a pair of spaced slits provided therein, said pair of spaced slits provided between said pair of spaced holes and said top edge of said extended portion and positioned along a vertical axis of said pair of spaced holes, said pair of spaced slits contiguous with said top edge of said extended portion, and a bottom portion joined to said top portion, said bottom portion formed of a net material and having a top end, wherein said bottom end of said top portion is fitted entirely within said top end of said bottom portion and wherein said top edge of said front panel extends substantially beyond said top end of said bottom portion.

8. The Produce Bag of claim 7, wherein said net material comprises:

a plurality of parallel horizontal strands, and a plurality of parallel vertical strands interwoven within said plurality of parallel horizontal strands.

9. The Produce Bag of claim 7, wherein said net material and said sheet material are a plastic material.

10. The Produce Bag of claim 9, wherein said plastic material is polyethylene.

* * * * *